United States Patent [19]

Stewart et al.

[11] 4,318,178

[45] Mar. 2, 1982

[54] CONTROL OF A CRACKING FURNACE

[75] Inventors: William S. Stewart; Gary L. Funk, both of Bartlesville, Okla.; Warren H. Huang, Taipei, Taiwan

[73] Assignee: Phillips Petroleum Co., Bartlesville, Okla.

[21] Appl. No.: 154,165

[22] Filed: May 28, 1980

[51] Int. Cl.[3] ..... G06F 15/46; C10G 9/36

[52] U.S. Cl. ..... 364/502; 23/230 A; 208/130; 208/DIG. 1; 364/148; 422/62; 585/650

[58] Field of Search ..... 364/109, 500, 501, 502, 364/503, 105; 208/106, 130, DIG. 1; 585/648, 650, 652, 501; 422/62, 109, 110, 119; 23/230 A

[56] References Cited

U.S. PATENT DOCUMENTS

| | | | |
|---|---|---|---|
| 2,972,447 | 2/1961 | White | 236/46 |
| 3,044,701 | 7/1962 | Kerstukos et al. | 364/500 |
| 3,048,331 | 8/1962 | Van Nice et al. | 364/500 |
| 3,057,584 | 10/1962 | Bretoi | 244/194 |
| 3,079,079 | 2/1963 | Phister et al. | 364/500 |
| 3,112,880 | 12/1963 | Pollock | 236/46 |
| 3,497,449 | 2/1970 | Urban | 364/109 X |
| 3,760,168 | 9/1973 | Boyd | 364/500 |
| 3,824,388 | 7/1974 | Cugini | 585/650 X |
| 3,828,171 | 8/1974 | Griffin | 364/105 |
| 4,231,753 | 11/1980 | Stewart | 364/500 X |

*Primary Examiner*—Joseph F. Ruggiero

[57] ABSTRACT

The heat provided to a cracking furnace is manipulated so as to substantially maximize the value of the product stream flowing from the cracking furnace. An analysis of the product stream may be utilized to measure the ratio of a first constituent in the product stream to a second constituent in the product stream (severity equivalent). The severity equivalent required to substantially maximize the value of the product stream may be calculated in response to process operating conditions. The heat supplied to the cracking furnace is manipulated in response to a comparison of the actual severity equivalent to the desired severity equivalent to thereby substantially maximize the value of the product stream.

17 Claims, 2 Drawing Figures

CONTROL OF A CRACKING FURNACE

Figure 1:
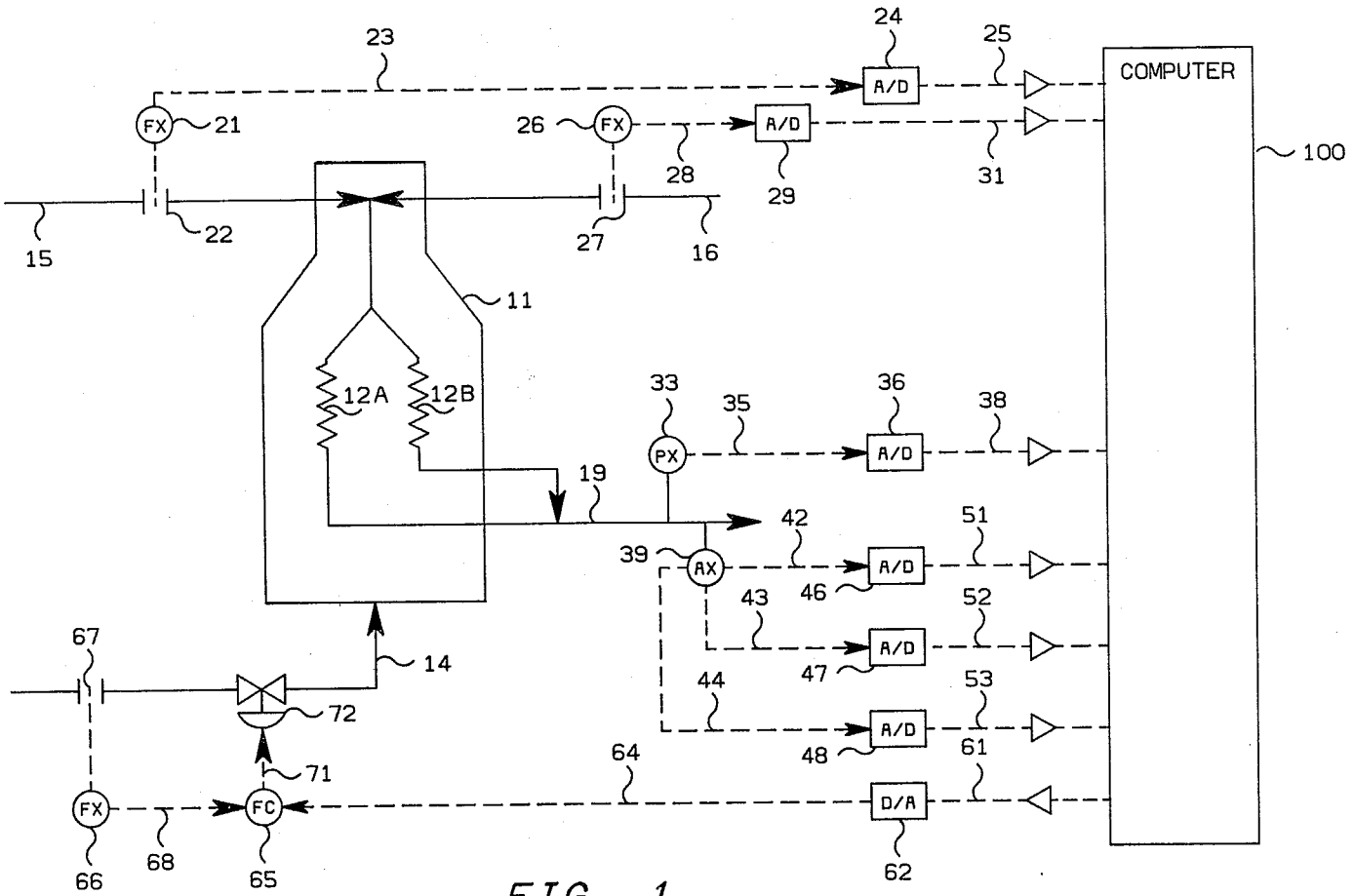

This invention relates to control of a cracking furnace. In a particular aspect, this invention relates to method and apparatus for substantially maximizing the value of the product stream flowing from a cracking furnace.

The cracking furnace forms the heart of many chemical manufacturing processes. Often the performance of the cracking furnace will carry the burden of the major profit potential for the entire manufacturing process. Close control of the cracking furnace is required to maximize the value of the product stream flowing from the cracking furnace.

In a manufacturing process such as the manufacture of ethylene, a naphtha feed stream or other suitable feed stream is fed into the cracking furnace. Within the furnace the feed gas is converted to a gaseous mixture. If the feed gas is a naphtha, the gaseous mixture will primarily contain hydrogen, methane, ethylene, ethane, propylene, propane, butadiene and small amounts of heavier gases. At the furnace exit this mixture is cooled, which allows removal of most of the heavier gases, and compressed.

The compressed mixture is routed through various distillation columns where the individual components such as ethylene are purified and separated. The separated products, of which ethylene is the major product, then leave the ethylene plant to be used in numerous other processes for the manufacture of a wide variety of secondary products.

The operation of a cracking furnace is generally measured against a performance index. This performance index can be any desired function depending upon the particular application of the cracking furnace. The preferred performance index in the present invention is defined as the economic value of the product stream flowing from the cracking furnace and it is an object of this invention to provide method and apparatus for substantially maximizing the value of the product stream flowing from a cracking furnace so as to substantially maximize the performance index of the cracking furnace.

In accordance with the present invention, method and apparatus is provided whereby the heat provided to a cracking furnace is manipulated so as to substantially maximize the value of the product stream flowing from the cracking furnace. An analysis of the product stream may be utilized to measure the ratio of a first constituent in the product stream to a second constituent in the product stream (severity equivalent). The severity equivalent required to substantially maximize the value of the product stream may be calculated in response to process operating conditions. The heat supplied to the cracking furnace is manipulated in response to a comparison of the actual severity equivalent to the desired severity equivalent to thereby substantially maximize the value of the product stream.

Figure 2:
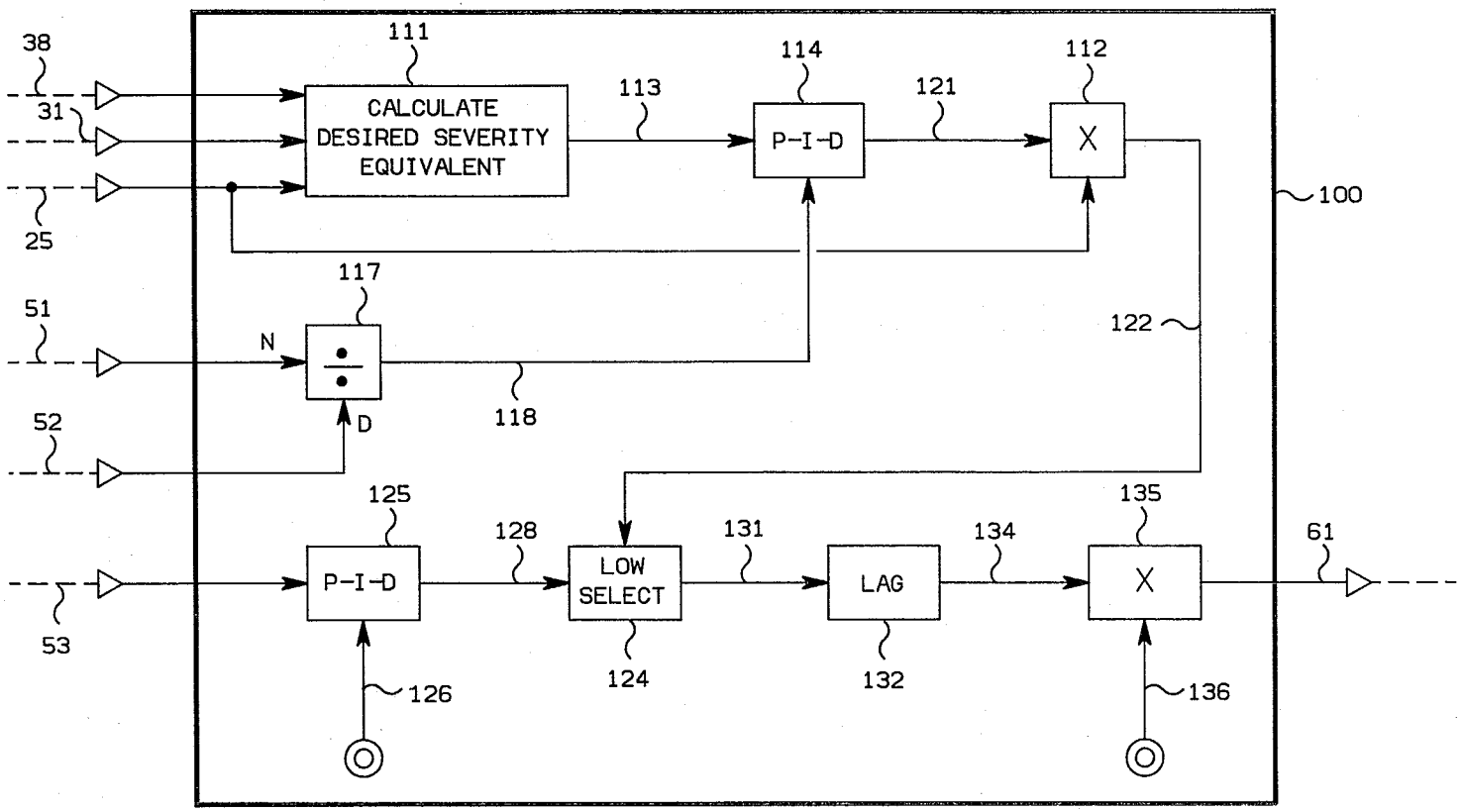

Other objects and advantages of the invention will be apparent from the foregoing brief description of the invention and the appended claims as well as from the detailed description of the drawings in which:

FIG. 1 is a schematic diagram of a cracking furnace with an associated control system; and FIG. 2 is a logic diagram for the computer logic utilized to generate the control signal utilized in the control of the cracking furnace illustrated in FIG. 1.

For the sake of simplicity, the invention is illustrated and described in terms of a single cracking furnace. However, the invention is also applicable to multiple furnaces.

The invention is also illustrated and described in terms of a process for the manufacture of ethylene. However, the applicability of the invention described herein extends to other processes wherein a cracking furnace is utilized to crack a feed into some desired components. A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from pressure sensors or flow sensors will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferably an Interdata, Model 732, integral with an Optrol 700 Process Control System, manufactured by Applied Automation, Inc. of Bartlesville, Okla.

Both the analog and digital controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention. The operation of proportional-integral-derivative controllers is well known in the art. The output control signal of a proportional-integral-derivative controller may be represented as $$S = K_1E + K_2\int Edt + K_3(dE/dt)$$

where

S = output control signals;

E = difference between two input signals; and $K_1$, $K_2$ and $K_3$ = constants of proportionality, integration and differentiation respectively.

The scaling of an output signal by a controller is well known in control systems art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual pressures equal. On the other hand, the same output signal could be scaled to represent a percentage or could be scaled to represent a temperature change required to make the desired and actual pressures equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize a process and the various signals generated thereby may take a variety of forms or formats. For example, the control elements of the system can be implemented using electrical analog, digital electronic, pneumatic, hydraulic, mechanical or other similar types of equipment or combinations of one or more of such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to FIG. 1, a conventional cracking furnace 11 is illustrated having two cracking tubes 12A and 12B. Heat is supplied to the two cracking tubes 12A and 12B by burners which are supplied with fuel through conduit means 14. Ordinarily a cracking furnace used in a process such as the manufacture of ethylene will have a larger number of cracking tubes. Also in a process such as the manufacture of ethylene a plurality of cracking furnaces will commonly be utilized.

A hydrocarbon such as a naphtha is provided as a feed to the cracking furnace 11 through conduit means 15. Steam is provided to the cracking furnace 11 through conduit means 16. The feed stream flowing through conduit means 15 and the steam flowing through conduit means 16 are combined within the cracking furnace 11 and flow through the cracking tubes 12A and 12B. After passing through the cracking tubes 12A and 12B, in which the feed gas is converted to ethylene, propylene and other gases, the gaseous mixture is combined and flows to various distillation columns through conduit means 19.

Flow transducer 21 in combination with the flow sensor 22, which is operably located in conduit means 15, provides an output signal 23 which is representative of the flow rate of the feed flowing through conduit means 15. Signal 23 is provided from the flow transducer 21 to the analog-to-digital (A/D) converter 24. Signal 23 is converted from analog form to digital form and is provided as signal 25 to computer means 100. In this manner flow transducer 26 in combination with the flow sensor 27, which is operably located in conduit means 16, provides an output signal 28 which is representative of the flow rate of the steam flowing through conduit means 16. Signal 28 is provided from the flow transducer 26 to the A/D converter 29. Signal 28 is converted from analog form to digital form and is provided as signal 31 to computer means 100.

Pressure transducer 33 in combination with a pressure sensing device, which is operably located in conduit means 19, provides an output signal 35 which is representative of the pressure of the effluent stream flowing through conduit means 19. Signal 35 is essentially representative of the pressure in the cracking tubes 12A and 12B. Signal 35 is provided from the pressure transducer 33 as an input to the A/D converter 36. Signal 35 is converted from analog form to digital form and is provided as signal 38 to computer means 100.

Analyzer transducer 39, which is preferably a chromatographic analyzer, is in fluid communication with conduit means 19. The analyzer transducer 39 provides a plurality of output signals which are representative of the analysis of various constituents of the product stream. An analysis could be performed to determine the concentration of a number of different constituents in the product stream. However, preferably only the concentration of methane, ethylene and acetylene are measured. Signal 42 provided from the analyzer transducer is representative of the methane concentration; signal 43 is representative of the ethylene concentration and signal 44 is representative of the acetylene concentration. Signals 42–44 are provided to the A/D converters 46–48, respectively. Signals 42–44 are converted from analog form to digital form and are provided as signals 51–53, respectively, to computer means 100.

In the present invention, the ratio of methane to ethylene in the product stream flowing through conduit means 19 is referred to as the "severity equivalent" for the cracking furnace 11. Other ratios could be utilized but the ratio of methane to ethylene is presently preferred.

In response to the described input signals, the computer means 100 calculates the severity equivalent for the cracking furnace 11 which is required to substantially maximize the economic value of the product flowing through conduit means 19. The required severity equivalent is compared to the actual severity equivalent and, if a process limitation is not exceeded, the comparison is utilized to derive a control signal which is representative of the flow rate of the fuel flowing through conduit means 14 which is required to maintain the actual severity equivalent substantially equal to the desired equivalent so as to substantially maximize the economic value of the product flowing through conduit means 19. Signal 61, which is representative of the required flow rate of the fuel flowing through conduit means 14, is provided as an output from the computer means 100. Signal 61 is provided as an input to the digital-to-analog (D/A) converter 62. Signal 61 is converted from digital form to analog form and is provided as signal 64 to the flow controller 65.

Flow transducer 66 in combination with the flow sensor 67, which is operably located in conduit means 14, provides an output signal 68 which is representative of the flow rate of the fuel flowing through conduit means 14. Signal 68 is provided from the flow transducer 68 as an input to the flow controller 65. The flow controller 65 provides an output signal 71 which is responsive to the difference between signals 64 and 68. Signal 71, which will be in pneumatic form, is provided as a control signal to the pneumatic control valve 72 which is operably located in conduit means 14. The pneumatic control valve 72 is manipulated in response to signal 71 to thereby maintain the actual flow rate of the fuel flowing through conduit means 14 substantially equal to the desired flow rate of the fuel flowing through conduit means 14. In this manner, the actual severity equivalent for the cracking furnace 11 is maintained substantially equal to the desired severity equivalent for the cracking furnace 11 so as to substantially maximize the economic value of the product stream flowing through conduit means 19.

The logic flow diagram utilized to calculate the control signal 61 in response to the previously described input signals to the computer means 100 is illustrated in FIG. 2. Referring now to FIG. 2, computer means 100 is shown as a solid heavy line surrounding the flow logic. Signals 38, 31 and 25, which are respectively representative of the pressure of the product stream, flow rate of the stream and flow rate of the feed stream, are provided as inputs to the calculate desired severity equivalent block 111. Signal 25 is also provided as an input to the multiplying block 112. In response to the described inputs, the severity equivalent required to substantially maximize the value of the product flowing through conduit means 19 is calculated. Signal 113 which is representative of the desired severity equivalent is provided as an output from the calculate desired severity equivalent block 111 to the P-I-D controller block 114.

Signal 51, which is representative of the concentration of methane in the product flowing through conduit means 19, is provided to the numerator input of the dividing block 117. Signal 52, which is representative of the concentration of ethylene in the product stream flowing through conduit means 19, is provided to the denominator input of the dividing block 117. Signal 51 is divided by signal 52 to establish signal 118 which is representative of the actual severity equivalent for the cracking furnace 11. Signal 118 is provided from the dividing block 117 as an input to the P-I-D controller block 114. The P-I-D controller block 114 provides an output signal 121 which is responsive to the difference between signals 113 and 118. Signal 121 is scaled so as to be representative of the number of Btu's required per pound of feed to maintain the actual severity equivalent substantially equal to the desired severity equivalent. Signal 121 is provided from the P-I-D controller 114 as an input to the multiplying block 112. Signal 121 is multiplied by signal 25 to establish signal 122 which is representative of the number of Btu's which must be provided to the cracking furnace 11 per hour to maintain the actual severity equivalent substantially equal to the desired severity equivalent. Signal 122 is provided from the multiplying block 112 as an input to the low select 124.

Signal 53, which is representative of the concentration of acetylene in the product stream flowing through conduit means 19, is provided as an input to the P-I-D controller 125. The P-I-D controller 125 is also provided with a set point signal 126 which is representative of the maximum concentration of acetylenes which is allowable in the product stream flowing through conduit means 19. The P-I-D controller 125 provides an output signal 128 which is responsive to the difference between signals 53 and 126. Signal 128 is scaled so as to be representative of the maximum number of Btu's which can be provided to the cracking furnace 11 per hour without exceeding the maximum allowable acetylenes concentration in the product stream flowing through conduit means 19. Signal 128 is provided from the P-I-D controller 125 as a second input to the low select 124. Signal 128 is essentially utilized as a safety feature in the present invention to prevent the concentration of acetylenes in the product flowing through conduit means 19 from going too high. Ordinarily, signal 122 will be selected by the low select 124. Only when the process model would demand a heat flow to the cracking furnace 11 which would produce excessive acetylenes in the product stream flowing through conduit means 19 will signal 128 be selected.

Signal 131 which is representative of the lower of signals 122 and 128 is provided from the low select 124 to the lag 132. The lag 132 is preferably a first order lag which is utilized to smooth the control of the cracking furnace 11 so as to prevent process upsets. The lag 132 provides an output signal 134 to the multiplying block 135. The multiplying block 135 is also provided with a set point signal 136 which is representative of the Btu content of the fuel flowing through conduit means 14. Signal 134 is multiplied by signal 136 to establish signal 61 which is representative of the flow rate of the fuel flowing through conduit means 14 required to maintain the actual severity equivalent substantially equal to the desired severity equivalent if a process constraint has not been exceeded. Signal 61 is provided as an output signal from computer means 100 and is utilized as has been previously described.

It is noted that, if the Btu content of the fuel varies, it may be desirable to provide an analysis of the fuel to determine the Btu content of the fuel and utilize this analysis in place of the set point signal 136. It is further noted that a number of process constraints will generally be present in the control system. Such constraints as maximum and minimum fuel flows will be utilized to insure that a malfunction in the model which is utilized to calculate the desired severity equivalent does not damage the cracking furnace or cause an unsafe operating condition. These process constraints have not been illustrated for the sake of simplicity since the process constraints play no part in the description of the present invention.

The desired severity equivalent could be calculated utilizing a number of different process models. The following is a description of the preferred method of calculating the desired severity equivalent.

To calculate the desired severity equivalent by the preferred method it is first necessary to calculate the concentration of a plurality of constituents in the product stream flowing through conduit means 19. For the present invention utilizing a naphtha feed stream the concentration of hydrogen, methane, acetylene, ethylene, ethane, propadiene, methylacetylene, propylene, propane, butadiene, butylene, butane, benzene, toluene, xylene, ethylbenzene, fuel oil and the gasoline fraction were calculated. The propadiene and methylacetylene were calculated as a group as where the xylenes and ethylbenzene.

The process model utilized to calculate the concentration of the constituents named above is as follows. Sixteen passes through the process model are required to calculate the required concentrations. The constants associated with the process model are changed for each calculation to derive the concentration of a particular constituent. Thus, in the process model set forth below the value of I ranges from 1 to 16.

$$Y(I) = B(I.1) + B(I.2)*X(1) + B(I.3)*X(2) + B(I.4)*X(3). + B(I.5)*(X(1)**2.) + B(I.6)*(X(2)**2.) + B(I.7)*(X(3)**2.) + B(I.8)*X(1)*X(2) + B(I.9)*X(3) + B(I.10)*X(2)*X(3) \quad (I)$$

where

Y(*I*)=concentration of a particular component in the product stream flowing through conduit means 19 where the particular component is determined by the value of I;

X(1)=the ratio of the flow rate of steam to the flow rate of the feed stream;

X(2)=outlet temperature of the product stream flowing through conduit means 19;

X(3)=pressure of the product stream flowing through conduit means 19; and all B terms equal constants.

As has been previously stated, the value of the B constants will change for each pass through the process model represented by Equation I. The values of the B constants are determined by performing a full range analysis on the product stream flowing from the cracking furnace 11 at different operating conditions. A regression type fit or a polynomial fit is then utilized to derive the values of the B constants which will enable the process model to give the concentrations measured in the process test. Once the B constants have been established, then the process model represented by Equation I can be utilized to predict the yield or concentration of each component in the product stream. The use of the process model represented by Equation I enables the concentration of the various components in the product stream to be accurately predicted without the use of an extremely time consuming analysis of a plurality of components in the product stream.

An example of a group B constants which were determined for a full range Kuwait naphtha are as follows. The constants are listed in computer notation.

TABLE I

| | Hydrogen I = 1 | Methane I = 2 | Acetylene I = 3 | Ethylene I = 4 | Ethane I = 5 | Methyacetylene Propadiene I = 6 | Propylene I = 7 | Propane I = 8 |
|---|---|---|---|---|---|---|---|---|
| B(I.1) | −.6034E 00 | .3108E-03 | −.6530E-01 | −.8492E-02 | .4438E-06 | .5667E-03 | .5264E-02 | .2566E-04 |
| B(I.2) | .6425E 01 | −.3815E-03 | −.9533E-02 | .1666E 00 | .2835E 02 | −.3689E-01 | −.7510E-01 | −.1650E 01 |
| B(I.3) | .5981E 00 | .1092E 02 | −.2112E-03 | .5014E-03 | −.1904E 02 | −.5778E-03 | .9782E-02 | .3333E 00 |
| B(I.4) | .6572E-03 | −.1250E-01 | .7110E 01 | −.1471E-01 | .9213E-01 | −.2307E 00 | .6686E-05 | −.5832E-03 |
| B(I.5) | −.2568E-03 | −.4998E-02 | −.9865E 01 | −.1412E-02 | −.4164E-02 | .1833E 00 | −.2316E 02 | .3156E-01 |
| B(I.6) | −.2265E 03 | .2887E 00 | .4460E 00 | .5472E 01 | −.9228E-04 | −.2416E-02 | −.9856E 01 | −.2853E-03 |
| B(I.7) | −.5716E 01 | −.6063E-03 | .2853E-05 | −.2853E-04 | .2579E 03 | .3548E 00 | .1489E 01 | .9531E 01 |
| B(I.8) | −.9924E-01 | −.2574E 01 | .2224E-04 | −.2250E-02 | .2818E 01 | .6427E-04 | −.1433E-02 | .1250E-01 |
| B(I.9) | .2194E-01 | .1251E-01 | −.1049E 03 | .1335E 00 | −.1450E 00 | .5897E 01 | −.3666E-04 | .1417E-02 |
| B(I.10) | .3330E-05 | −.2499E-03 | .1284E 02 | −.1212E-03 | −.1395E-01 | −.3751E-01 | .8862E 02 | −.1160E 00 |

| | Butadiene I = 9 | Butylene I = 10 | Butane I = 11 | Benzene I = 12 | Toluene I = 13 | Xylenes Ethylbenzene I = 14 | Gasoline I = 15 | Fuel Oil I = 16 |
|---|---|---|---|---|---|---|---|---|
| B(I.1) | .3133E-07 | .9594E-06 | −.1701E 03 | .1892E 00 | .4457E 00 | .1925E 01 | −.4450E-04 | .3334E-02 |
| B(I.2) | .1167E-04 | .2083E-03 | −.2130E 01 | .3033E-04 | .3159E-02 | .2292E-01 | −.5912E 03 | .7209E 00 |
| B(I.3) | −.9741E 02 | .1256E 00 | .1889E 00 | .1826E 01 | −.3946E-04 | .3336E-03 | −.2478E 01 | −.9987E-04 |
| B(I.4) | .2326E-02 | −.5345E-04 | .4767E-03 | .4165E-02 | −.6374E 03 | .8171E 00 | .2249E 01 | .1699E 02 |
| B(I.5) | .1079E 00 | −.5142E 00 | −.1134E-04 | −.4977E-04 | −.5219E 01 | −.9307E-04 | .4960E-02 | .4000E-01 |
| B(I.6) | .6083E-02 | .7915E-01 | −.2889E 03 | .3768E 00 | .9333E 00 | .9142E 01 | −.1223E-03 | .1238E-05 |
| B(I.7) | −.1178E-03 | −.2498E-02 | −.5960E 01 | −.9628E-03 | .3896E-05 | −.4006E-04 | .1082E 03 | −.9875E-01 |
| B(I.8) | −.1088E 03 | .1225E 00 | −.6533E 00 | .2785E 00 | −.3780E-04 | .4160E-03 | −.2150E 02 | .4384E-03 |
| B(I.9) | .1901E 02 | .7842E-04 | −.2325E-01 | −.1250E-01 | .2587E 01 | −.1239E-02 | .2411E 00 | .2380E 01 |
| B(I.10) | −.2032E 00 | −.3791E 01 | .3911E-04 | −.1694E-04 | .1457E 01 | .1523E-03 | .6427E-03 | −.1499E-01 |

The values of the ratio of the steam flow rate to feed flow rate and the pressure of the product stream are provided by process measurements. The outlet temperature in Equation I is varied and the value of the product stream is calculated for each temperature at the measured process conditions by simply multiplying the concentration of a particular component by the value of that component. The outlet temperature is varied until the maximum value of the product stream is achieved. This may be accomplished by a non-linear optimization program or other similar programs. Such an optimization program is described and discussed in Churchman, C. W., R. L. Ackoff, and E. L. Arnoff, "Introduction to Operations Research," pp. 304–316, John Wiley & Sons, Inc., New York, N.Y. 1957.

Once the yield has been determined which gives the maximum economic value for the product stream flowing through conduit means 19, the methane concentration in the calculated yield is divided by the ethylene concentration to give the desired severity equivalent which is provided as the output signal 113 from the calculate desired severity equivalent block 111.

The process model set forth in FIG. 1 provides a means for calculating the yield of the cracking furnace under various process operating conditions. Changes in the feed rate or steam flow rate or the pressure at the outlet of the cracking furnace are compensated for by the model. Thus, method and apparatus are provided by which the performance index (economic value of the product stream) of the cracking furnace is maximized even when process conditions are changing.

The invention has been described in terms of a preferred embodiment as illustrated in FIGS. 1 and 2. Specific components which can be used in the practice of the invention as illustrated in FIG. 1 such as flow sensors 22, 27, and 67; flow transducers 21, 26, and 66; flow controller 65; pneumatic control valve 72; and pressure transducer 33 are each well known, commercially available control components such as are illustrated and described at length in Perry's *Chemical Engineers Handbook,* 4th Edition, Chapter 22, McGraw-Hill. A suitable analyzer 39 is the process chromatograph system, model 102, manufactured by Applied Automation, Inc., Bartlesville, Okla. A suitable A/D converter 24, 29, 36, 46, 47, and 48 is the MM5357 8-bit A/D converter manufactured by National Semiconductor Corporation, Santa Clara, Calif. A suitable D/A converter 62 is the AD559 8-bit D/A converter manufactured by Analog Devices, Norwood, Mass.

While the invention has been described in terms of the presently preferred embodiment, reasonable variations and modifications are possible by those skilled in the art, within the scope of the described invention and the appended claims.

That which is claimed is:

1. Apparatus comprising:

a cracking furnace means;

means for supplying a feed stream to said cracking furnace means;

means for supplying a diluent fluid to said cracking furnace means, said diluent fluid being combined with said feed stream;

means for supplying a fuel to said cracking furnace means, the combustion of said fuel supplying heat to said cracking furnace means;

means for removing a gaseous mixture, containing the cracked components of said feed stream and containing said diluent fluid, from said cracking furnace means;

means for establishing a first signal representative of the actual ratio of the concentration of a first component in said gaseous mixture to the concentration of a second component in said gaseous mixture;

means for establishing a second signal representative of the ratio of the concentration of said first component in said gaseous mixture to the concentration of said second component in said gaseous mixture required to substantially maximize the performance index of said cracking furnace means;

means for comparing said first signal and said second signal and for establishing a third signal responsive to the difference between said first signal and said second signal; and means for manipulating the flow rate of said fuel in response to said third signal to thereby substantially maximize the performance index of said cracking furnace means.

2. Apparatus in accordance with claim 1 wherein said performance index is the economic value of said gaseous mixture.

3. Apparatus in accordance with claim 1 wherein said means for establishing said first signal comprises:

means for analyzing said gaseous mixture and for establishing fourth and fifth signals which are respectively representative of the concentration of said first component in said gaseous mixture and the concentration of said second component in said gaseous mixture; and means for dividing said fourth signal by said fifth signal to establish said first signal.

4. Apparatus in accordance with claim 3 wherein said first component is methane and said second component is ethylene.

5. Apparatus in accordance with claim 2 wherein said means for establishing said second signal comprises:

means for establishing a fourth signal representative of the flow rate of said feed stream;

means for establishing a fifth signal representative of the flow rate of said diluent fluid;

means for establishing a sixth signal representative of the pressure of said gaseous mixture; and means for establishing said second signal in response to said fourth, fifth and sixth signals.

6. Apparatus in accordance with claim 5 wherein said means for establishing said second signal in response to said fourth, fifth and sixth signals comprises:

means for calculating a plurality of gaseous mixture analyses at the process conditions represented by said fourth, fifth and sixth signals and at a plurality of temperatures of said gaseous mixture;

means for determining the economic value of said gaseous mixture at each temperature of said gaseous mixture; and means for dividing the concentration of said first component by the concentration of said second component in the gaseous mixture which has the highest economic value to thereby establish said second signal.

7. Apparatus in accordance with claim 1 wherein said means for manipulating the flow rate of said fuel in response to said third signal comprises:

means for establishing a fourth signal representative of the flow rate of said feed stream;

means for manipulating said third signal by said fourth signal to establish a fifth signal representative of the number of Btu's which must be supplied to said cracking furnace means per hour to maintain said first signal substantially equal to said second signal;

means for establishing a sixth signal representative of the number of Btu's provided to said cracking furnace means per pound of said fuel;

means for multiplying said fifth signal by said sixth signal to establish a seventh signal representative of the required flow rate of said fuel;

means for establishing an eighth signal representative of the actual flow rate of said fuel;

means for comparing said seventh signal and said eighth signal and for establishing a ninth signal responsive to the difference between said seventh signal and said eighth signal; and means for manipulating the flow rate of said fuel in response to said eighth signal.

8. Apparatus in accordance with claim 1 wherein said means for manipulating the flow rate of said fuel in response to said third signal comprises:

means for establishing a fourth signal representative of the flow rate of said feed stream;

means for multiplying said third signal by said fourth signal to establish a fifth signal representative of the number of Btu's which must be provided to said cracking furnace means per hour to maintain said first signal substantially equal to said second signal;

means for establishing a sixth signal representative of the concentration of acetylene in said gaseous mixture;

means for establishing a seventh signal representative of the maximum allowable concentration of acetylene in said gaseous mixture;

means for comparing said sixth signal and said seventh signal and for establishing an eighth signal responsive to the difference between said sixth signal and said seventh signal, said eighth signal being representative of the maximum number of Btu's which can be supplied to said cracking furnace means per hour without exceeding the limitation on the acetylene concentration in said gaseous mixture represented by said seventh signal;

low select means;

means for providing said fifth signal and said eighth signal as inputs to said low select means, said low select means establishing a ninth signal representative of the lower of said fifth and said eighth signals;

means for establishing a tenth signal representative of the Btu content of said fuel;

means for multiplying said ninth signal by said tenth signal to establish an eleventh signal representative of the required flow rate of said fuel;

means for establishing a twelfth signal representative of the actual flow rate of said fuel;

means for comparing said eleventh signal and said twelfth signal and for establishing a thirteenth signal responsive to the difference between said eleventh signal and said twelfth signal; and means for manipulating the flow rate of said fuel in response to said thirteenth signal.

9. A method for substantially maximizing the performance index of a cracking furnace in which a mixture of a feed stream and a diluent fluid are cracked to produce a gaseous mixture which contains the cracked components of said feed stream and contains said diluent fluid, said method comprising the steps of:

establishing a first signal representative of the actual ratio of the concentration of a first component in said gaseous mixture to the concentration of a second component in said gaseous mixture;

establishing a second signal representative of the ratio of the concentration of said first component in said gaseous mixture to the concentration of said second component in said gaseous mixture required to substantially maximize the performance index of said cracking furnace;

comparing said first signal and said second signal and establishing a third signal responsive to the difference between said first signal and said second signal; and supplying heat to said cracking furnace in response to said third signal to thereby substantially maximize the economic value of said gaseous mixture.

10. A method in accordance with claim 9 wherein said performance index is the economic value of said gaseous mixture.

11. A method in accordance with claim 9 wherein said step of establishing said first signal comprises:

analyzing said gaseous mixture and establishing fourth and fifth signals which are respectively representative of the concentration of said first component in said gaseous mixture and the concentration of said second component in said gaseous mixture; and dividing said fourth signal by said fifth signal to establish said first signal.

12. A method in accordance with claim 11 wherein said first component is methane and said second component is ethylene.

13. A method in accordance with claim 10 wherein said step of establishing said second signal comprises:

establishing a fourth signal representative of the flow rate of said feed stream to said cracking furnace;

establishing a fifth signal representative of the flow rate of said diluent fluid to said cracking furnace;

establishing a sixth signal representative of the pressure of said gaseous mixture; and establishing said second signal in response to said fourth, fifth and sixth signals.

14. A method in accordance with claim 13 wherein said step of establishing said second signal in response to said fourth, fifth and sixth signals comprises:

calculating a plurality of gaseous mixture analyses at the process conditions represented by said fourth, fifth and sixth signals and at a plurality of temperatures of said gaseous mixture;

determining the economic value of said gaseous mixture at each temperature of said gaseous mixture; and dividing the concentration of said first component by the concentration of said second component in the gaseous mixture which has the highest economic value to thereby establish said second signal.

15. A method in accordance with claim 9 wherein the combustion of a fuel flowing to said cracking furnace supplies heat to said cracking furnace and said step of supplying heat to said cracking furnace in response to said third signal is accomplished by manipulating the flow rate of said fuel in response to said third signal.

16. A method in accordance with claim 15 wherein said step of manipulating the flow rate of said fuel in response to said third signal comprises:

establishing a fourth signal representative of the flow rate of said feed stream to said cracking furnace;

multiplying said third signal by said fourth signal to establish a fifth signal representative of the number of Btu's which must be supplied to said cracking furnace per hour to maintain said first signal substantially equal to said second signal;

establishing a sixth signal representative of the number of Btu's provided to said cracking furnace per pound of said fuel;

multiplying said fifth signal by said sixth signal to establish a seventh signal representative of the required flow rate of said fuel to said cracking furnace;

establishing an eighth signal representative of the actual flow rate of said fuel to said cracking furnace;

comparing said seventh signal and said eighth signal and establishing a ninth signal responsive to the difference between said seventh signal and said eighth signal; and manipulating the flow rate of said fuel to said cracking furnace in response to said eighth signal.

17. A method in accordance with claim 15 wherein said step of manipulating the flow rate of said fuel in response to said third signal comprises:

establishing a fourth signal representative of the flow rate of said feed stream to said cracking furnace;

multiplying said third signal by said fourth signal to establish a fifth signal representative of the number of Btu's which must be provided to said cracking furnace per hour to maintain said first signal substantially equal to said second signal;

establishing a sixth signal representative of the concentration of acetylene in said gaseous mixture flowing from said cracking furnace;

establishing a seventh signal representative of the maximum allowable concentration of acetylene in said gaseous mixture flowing from said cracking furnace;

comparing said sixth signal and said seventh signal and establishing an eighth signal responsive to the difference between said sixth signal and said seventh signal, said eighth signal being representative of the maximum number of Btu's which can be supplied to said cracking furnace per hour without exceeding the limitation on the acetylene concentration in said gaseous mixture represented by said seventh signal;

establishing a ninth signal representative of the lower of said fifth and said eighth signals;

establishing a tenth signal representative of the Btu content of said fuel;

multiplying said ninth signal by said tenth signal to establish an eleventh signal representative of the required flow rate of said fuel to said cracking furnace;

establishing a twelfth signal representative of the actual flow rate of said fuel to said cracking furnace;

comparing said eleventh signal and said twelfth signal and establishing a thirteenth signal responsive to the difference between said eleventh signal and said twelfth signal; and means for manipulating the flow rate of said fuel in said cracking furnace in response to said thirteenth signal.

* * * * *

UNITED STATES PATENT AND TRADEMARK OFFICE

CERTIFICATE OF CORRECTION

PATENT NO. : 4,318,178

DATED : March 2, 1982

INVENTOR(S) : William S. Stewart, et al

It is certified that error appears in the above—identified patent and that said Letters Patent is hereby corrected as shown below:

Claim 7, column 10, line 36, after "for", "manipulating" should be --- multiplying --- .

Signed and Sealed this

*Tenth* Day of *August 1982*

[SEAL]

*Attest:*

GERALD J. MOSSINGHOFF

*Attesting Officer* *Commissioner of Patents and Trademarks*